US005273451A

United States Patent [19]

Lin

[11] Patent Number: 5,273,451

[45] Date of Patent: Dec. 28, 1993

[54] CLAMP FIXING STRUCTURE OF CIRCUIT BOARD CONNECTOR

[75] Inventor: Carol S. M. Lin, Taoyuan, Taiwan

[73] Assignee: Full Rise Electronics Inc., Taiwan

[21] Appl. No.: 902,029

[22] Filed: Jun. 22, 1992

[51] Int. Cl.[5] ..... H01R 13/52

[52] U.S. Cl. ..... 439/326

[58] Field of Search ..... 439/326, 327, 328, 350-358, 439/62, 65

[56] References Cited

U.S. PATENT DOCUMENTS

| | | | |
|---|---|---|---|
| 4,008,942 | 2/1977 | Grossi | 439/328 |
| 4,129,896 | 12/1978 | Young | 439/358 |
| 4,550,362 | 10/1985 | Reimer | 439/328 |
| 4,778,411 | 10/1988 | Rudy, Jr. et al. | 439/358 |
| 4,941,838 | 7/1990 | Zinn | 439/358 |
| 5,123,857 | 6/1992 | Lee Chao | 439/326 |

*Primary Examiner*—David L. Pirlot

*Attorney, Agent, or Firm*—Larson and Taylor

[57] ABSTRACT

A clamp fixing structure for connecting circuit boards. The structure includes an inlet slot terminal on each end of a connecting socket and a fixing set to be assembled with each terminal. Below and adjacent to the terminal are a catch slot and fixing holes, and a vertical slide guide is on one side of the terminal. On the fixing set, at corresponding mating positions of the catch slot, fixing holes, and slide guide of the terminal are respectively hook, inserting pins, and a slide to firmly fix a metal clamp when the fixing set is assembled with the inlet slot terminal.

8 Claims, 4 Drawing Sheets

CLAMP FIXING STRUCTURE OF CIRCUIT BOARD CONNECTOR

FIELD OF THE INVENTION

The present invention relates to a new clamp fixing structure for connecting sockets on printed-circuit boards. The principle is to have a slot-like inlet terminal on each end of the connecting socket, and a matching slot and two fixing holes below and adjacent to the terminal; there are a vertical slide guide on one side of the inlet terminal, and an additional fixing set which is to be assembled into the terminal. To help in the mounting or fixing of a metal clamp firmly when the fixing sets are assembled into the inlet terminals, the positions of the hook, inserting pins, and slide of the fixing set correspond to the matching slot, fixing holes, and slide guide on the inlet terminal respectively.

BACKGROUND OF THE INVENTION

The common way for connecting an additional circuit board, especially the printed-circuit board connection inside a computer, is to vertically mount the additional circuit boards on the mother board with a connecting socket. That kind of socket has an inlet port on either side of the socket for the add-on card to stay on proper position, as shown in FIGS. 8 and 9. Those inlet ports and the main socket body are formed in one integrated unit employing high-temperature resistant compound materials. The characteristics of these compounds are hard and easy to break. Hence, during the assembling-disassembling process of the add-on card, the inlet port is often broken. The other case is due to the compound's modulus of rigidity being very high which leads to a larger force being required to take-out or put-in a card into a socket. Thus it is more difficult to control the operation.

Furthermore, the way to fix the conventional type socket on the mother board is by means of pins on both sides of the bottom of the socket. To have a simple indication of assembly direction, the pins of different sides have different diameters. Because of this, the pin of smaller diameter is less rigid and has a high probability to break off the socket body when a force applies to it.

SUMMARY OF THE INVENTION

To solve the aforementioned problem, the present invention has developed a clamp fixing structure. It replaces the mounting or fixation function of the inlet port of a conventional socket by a metal clamp, by means of an additional fixing set to fix the clamp on the socket assembly. Hence the assembling-disassemble process of an add-on circuit card becomes easy and simple, and does not break any part of the card or the socket because of the excellent elasticity of a metal clamp. This is the major function of this invention.

Moreover, when the metal clamp is damaged by accident, instead of replacing the entire connector, one needs only insert a new clamp to keep the operation of the socket in order.

Besides the pins beneath the bottom of the socket can be formed from the extension of the fixing set which is made of a tough material. Hence, the pins of this kind are hard to break, and can also be replaced (by changing the fixing set).

DESCRIPTION OF THE PREFERRED EMBODIMENTS

Figure 1:
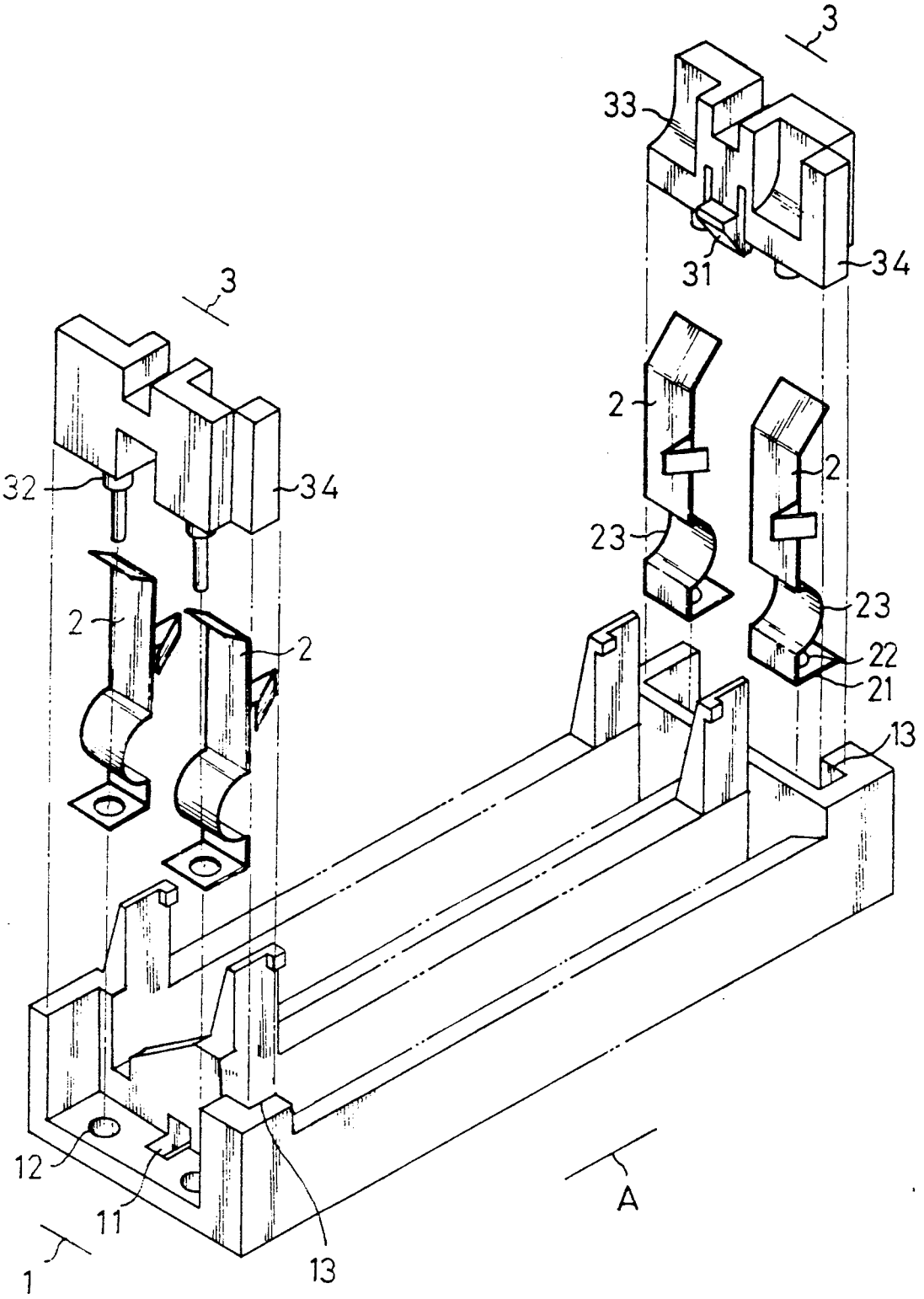
FIG. 1 is an exploded perspective view of one embodiment of the present invention.

Please refer to the drawings and following descriptions for the details of this invention FIG. 1 shows the connecting socket(A) of this invention with the inlet slot terminals(1) on its both sides. Below and adjacent to the inlet slot terminal(1) are a matching slot(11) and two mounting or fixing holes(12). A vertical slide guide(13) is located at one side of the socket end.

The fixing set(3) to be assembled into the inlet slot terminal(1) is made of tough material. There are a hook(31) and inserting pins(32) on the fixing set(3) with respect to the positions of matching slot(11) and fixing holes(12) of the terminal(1) respectively. The fixing set(3) has two concave arcuate slots(33) on its inner side and vertical slide(34) corresponding the slide guide(13) of the inlet slot terminal.

There is a metal clamp(2), the lower part of the clamp(2) having a horizontal support(21). A hole(22) is located at the center of the support(21) and above support(21) is an elastic convex arcuate surface(33) which corresponds to concave arcuate slots(33) of the fixing set(3).

Figure 3:
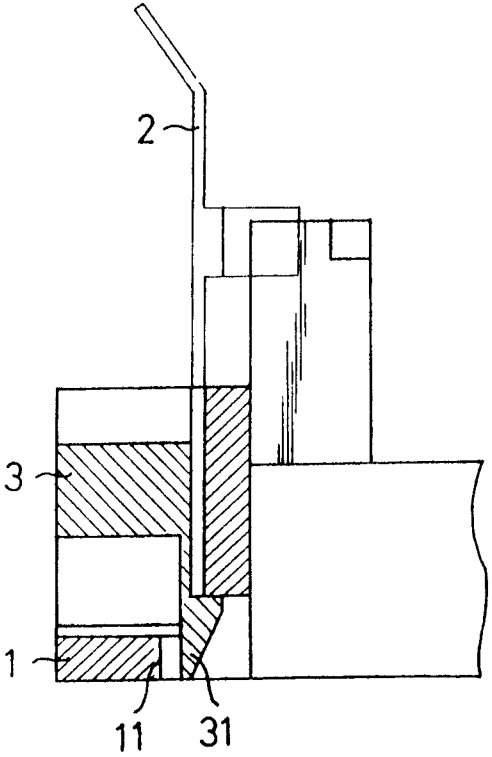
FIG. 3 is a side elevational view, partly in cross section depicting the combinations of the fixing set and the inlet slot terminal.
Figure 2:
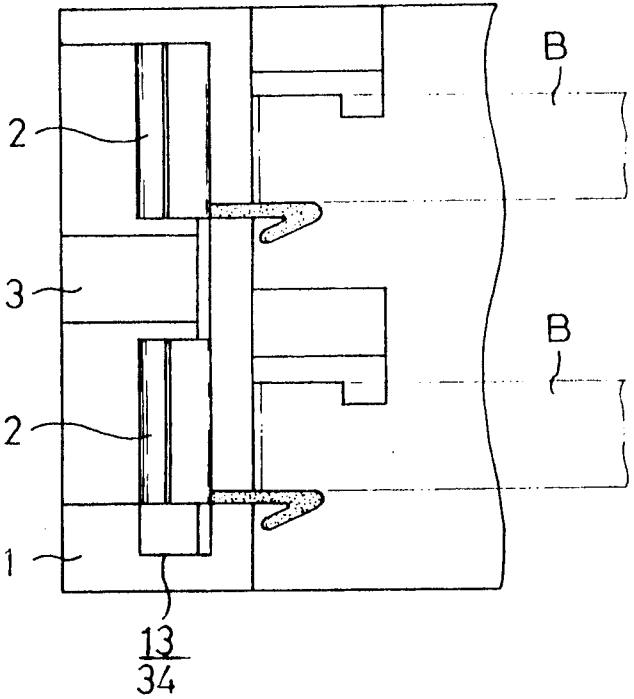
FIG. 2 is a top plan view of the assembled.
Figure 4:
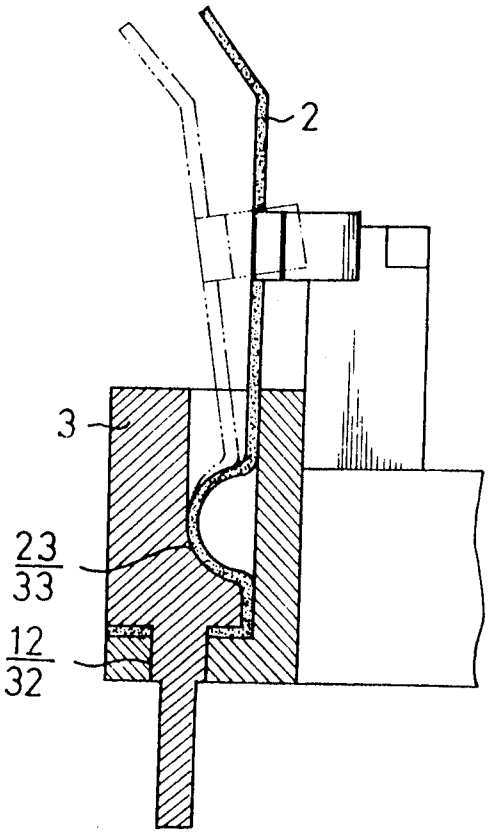
FIG. 4 is a side elevational view, partly in cross section depicting the fixation of the metal clamp on the fixing set.

To assemble the above structures, as shown in FIGS. 2, 3, and 4, the fixing set(3) is horizontally fixed on inlet slot terminal(1) by slide(34) and the inserting pins(32). The hook(31) is put into the catch slot(11) to provide auxiliary fixation. Hence, the metal clamp(2) is pinched by the fixing set(3), and its elastic arc(23) is exactly positioned on the concave arcs(33).

When the metal clamp(2) is assembled with the connecting socket(A) and the fixing set(3), it can provide adequate elasticity and brake during the insertion or withdrawal of an add-on circuit card.

Figure 5:
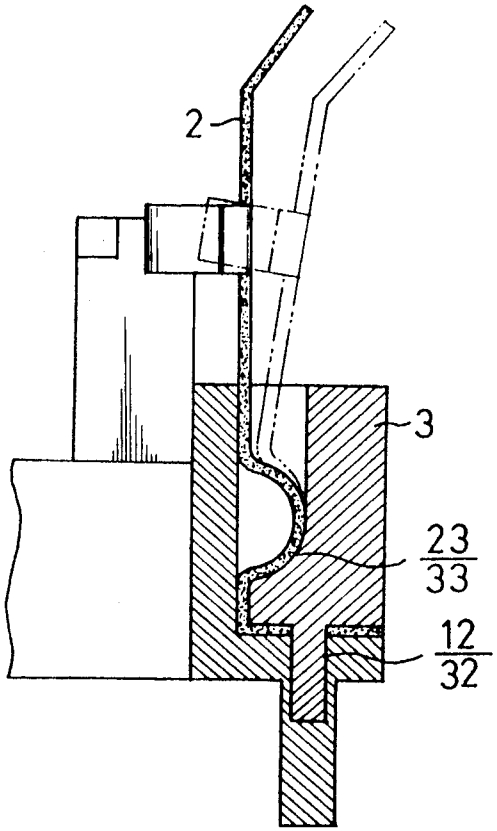
FIG. 5 is a side elevational view, partly in cross section of an alternative embodiment of the pins of the fixing set.

As to the inserting pins(32) of the fixing set(3), when the diameter of the bottom pins of the connecting socket(A) is greater than the one of the inserting pins(32), the inserting pins(32) can be buried in the pins of the socket(A) to provide reliable fixation as shown in FIG. 5.

Figure 6:
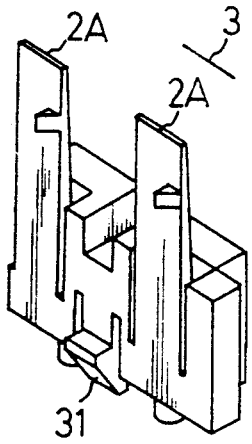
FIG. 6 is a perspective view of an alternative embodiment of the clamp.
Figure 7:
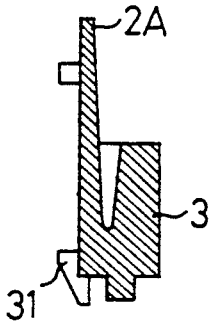
FIG. 7 is an cross sectional view of FIG. 6.
Figure 8:
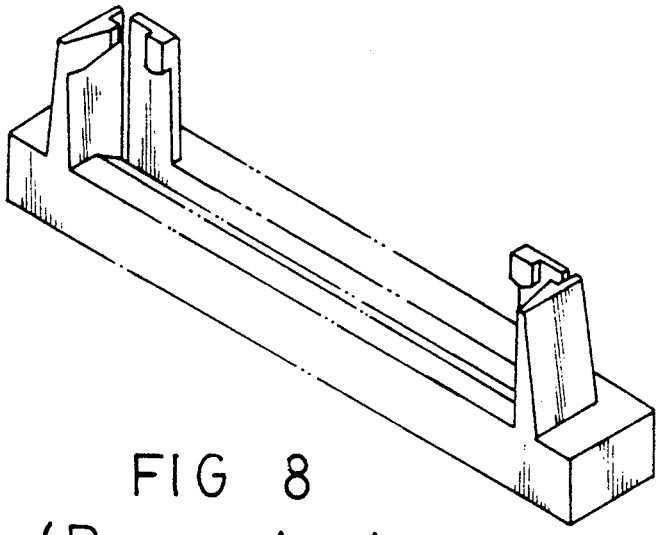
FIG 8 (Prior Art)
FIG. 8 is a perspective view of a prior art connector.
Figure 9:
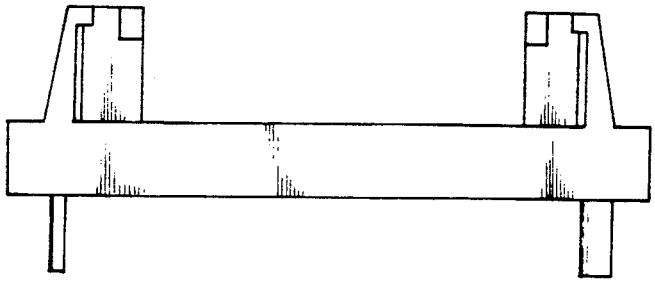
FIG 9 (Prior Art)
FIG. 9 is a front elevational view of the prior art connector of FIG. 8.

The above is one practical instance of this invention employing the metal clamp(2). The other variety of this technique is shown in FIGS. 6 and 7. The difference is that the metal clamp(2) is replaced by a plastic clamp(2A) which is integrated in one with the fixing set(3). The elasticity and brake of this clamp(2A) is good too.

To sum up, this invention uses the combination of a fixing set and an inlet slot terminal of the connecting socket to stably fix the metal clamp which provides a brake to the insertion of an add-on card. This invention eliminates the defects of conventional connectors which are easy to break and hard to operate and is a pretty practical design.

Hence it is presented to apply for a patent to protect the right appertaining to the invention.

What is claimed is:

1. A clamp attaching structure for a connecting socket having two ends comprising:

a terminal having an inlet slot at each of the two ends of the connecting socket;

a fixing set that can be assembled with each of said connecting socket terminals, said fixing set having an inner side that is adjacent to the connecting socket when assembled and having a concave arcuate surface on said inner side;

a catch slot and at least one fixing hole located below and adjacent to the inlet slot in said terminals;

a hook and at least one mounting pin on each said fixing set which are capable of respectively mating with said catch slot and fixing hole in a corresponding terminal; and a clamp having an elastic convex arcuate surface which can mate with said fixing set concave arcuate surface, said clamp being mountable on the connecting socket by said fixing set;

wherein said terminal includes at least one mounting pin which has a coaxial bore therein; and wherein said mounting pin of the fixing set is aligned with and receivable by the corresponding bore of said terminal mounting pins.

2. A clamp attaching structure as claimed in claim 1 wherein said clamp includes an upstanding body portion which includes said convex arcuate surface and an integral base at one end of said body portion extending in a substantially horizontally direction when said clamp is mounted on the connecting socket, said base having an orifice therein for receiving a mounting pin and being sandwiched between the bottom of said fixing set and the top of said inlet slot terminal.

3. A clamp attaching structure as claimed in claim 1 wherein said clamp is metal and is a separate part of said structure.

4. A clamp attaching structure for a connecting socket having two ends comprising:

a terminal having an inlet slot at each of the two ends of the connecting socket;

a fixing set that can be assembled with each of said connecting socket terminals, said fixing set having an inner side that is adjacent to the connecting socket when assembled;

a catch slot and at least one fixing hole located below and adjacent to the inlet slot in each of said terminals;

a hook and at least one mounting pin on each said fixing set which are capable of respectively mating with said catch slot and fixing hole in a corresponding terminal; and a clamp which is mountable on the connecting socket by said fixing set;

wherein said fixing set is comprised of plastic and wherein said clamp is plastic and is integral with said fixing set so that said clamp and fixing set are in one unit;

wherein each of said terminals further includes a vertical slide guide located at a side thereof; and wherein said fixing set has a slide for engaging and mating with said slide guide, the slide and slide guide when engaged and the mounting pins and fixing holes when engaged serving to horizontally fix said fixing guide on said inlet slot terminal.

5. A clamp attaching structure as claimed in claim 1 wherein each of said terminals further includes a vertical slide guide located at a side thereof; and wherein said fixing set has a slide for engaging and mating with said slide guide; the slide and slide guide when engaged and the mounting pins and fixing holes when engaged serving to horizontally fix said fixing guide on said inlet slot terminal.

6. A clamp attaching structure as claimed in claim 5 wherein said clamp includes an upstanding body portion which includes said convex arcuate surface and an integral base at one end of said body portion extending in a substantially horizontally direction when said clamp is mounted on the connecting socket, said base having an orifice therein for receiving a mounting pin.

7. A connector for connecting add-on circuit boards to a printed circuit board, the connector comprising in combination:

an elongate connector housing having a plurality of sockets, each socket for receiving an add-on circuit board, said housing having a terminal at each end thereof, each terminal including an inlet slot therein having a bottom defined by an upper surface of said terminal, a catch slot located below said upper surface and adjacent to said inlet slot, a plurality of fixing holes located in said upper surface, and a vertical slide guide located on one side of said terminal;

a fixing set mountable in each terminal, each said fixing set including a hook, a plurality of inserting pins equal in number to the number of fixing holes, and a slide, said hook, inserting pins and slide being respectively located at corresponding mating positions for said catch slot, said fixing holes, and said slide guide, and said fixing set having an inner side that is adjacent to the connecting socket when assembled and having a plurality of concave arcuate surfaces on said inner side, the number of said concave arcuate surfaces being equal to the number of said sockets; and a plurality of clamps for each fixing set, the number of said clamps being equal to the number of sockets, each said clamp having an elastic convex arcuate surface which can mate with a corresponding one of said fixing set concave arcuate surfaces, whereby said clamp is mountable on the connecting socket by said fixing set.

8. A clamp attaching structure as claimed in claim 7 wherein each sad clamp includes an upstanding body portion which in turn includes said convex arcuate surface and an integral base at one end of said body portion extending in a substantially horizontally direction when said clamp is mounted on the connecting socket, said base having an orifice therein for receiving a mounting pin and when mounted being sandwiched between a bottom portion of said fixing set and said terminal upper surface.

* * * * *